US006988749B2

(12) United States Patent
Hashiba et al.

(10) Patent No.: US 6,988,749 B2
(45) Date of Patent: Jan. 24, 2006

(54) DOOR LOCKING SYSTEM FOR MOTOR VEHICLE

(75) Inventors: Yasuhiro Hashiba, Kanagawa-ken (JP); Shigeru Takeuchi, Kanagawa-ken (JP); Yasunori Sahashi, Aichi-ken (JP)

(73) Assignees: Shiroki Corporation, Kanagawa-ken (JP); Ansei Corporation, Aichi (JP)

( * ) Notice: Subject to any disclaimer, the term of this patent is extended or adjusted under 35 U.S.C. 154(b) by 0 days.

(21) Appl. No.: 10/456,504

(22) Filed: Jun. 9, 2003

(65) Prior Publication Data

US 2004/0245786 A1 Dec. 9, 2004

(51) Int. Cl.
*E05C 3/06* (2006.01)

(52) U.S. Cl. ..... 292/201; 292/216; 292/DIG. 23

(58) Field of Classification Search ..... 292/199, 292/201, 216, DIG. 23, 210, DIG. 65, DIG. 22
See application file for complete search history.

(56) References Cited

U.S. PATENT DOCUMENTS

| | | | | |
|---|---|---|---|---|
| 5,632,515 | A * | 5/1997 | Dowling | 292/216 |
| 5,901,991 | A * | 5/1999 | Hugel et al. | 292/201 |
| 6,076,868 | A * | 6/2000 | Roger, Jr. et al. | 292/201 |
| 6,341,807 | B2 * | 1/2002 | Cetnar et al. | 292/201 |
| 6,550,826 | B2 * | 4/2003 | Fukushima et al. | 292/201 |
| 6,557,910 | B2 * | 5/2003 | Amano | 292/201 |
| 6,557,911 | B2 * | 5/2003 | Nelsen et al. | 292/216 |

FOREIGN PATENT DOCUMENTS

| | | |
|---|---|---|
| JP | 6-65584 | 9/1994 |
| JP | 08013880 | 1/1996 |
| JP | 10148051 | 6/1998 |

* cited by examiner

*Primary Examiner*—Brian E. Glessner
*Assistant Examiner*—Christopher Boswell
(74) *Attorney, Agent, or Firm*—Millen, White, Zelano, Branigan, P.C.

(57) ABSTRACT

A door locking system for a motor vehicle includes a striker fixed to one of a car body and a car door, a base plate fixed to the other of the car body and the car door, the base plate having a striker leading slot in which the striker is removably insertable, a latch for latching the striker, the latch being pivoted on the base plate on one side of the striker leading slot, a pawl for locking and unlocking the latch, the pawl being pivoted on the base plate on the other side of the striker leading slot, a rotary pressing member driven to rotate the pawl to disengage the latch from the striker, and a rotatable opening lever which is manually rotated to disengage the latch. The rotary pressing member and the rotatable opening lever are pivoted about a common rotational shaft.

27 Claims, 11 Drawing Sheets

DOOR LOCKING SYSTEM FOR MOTOR VEHICLE

BACKGROUND OF THE INVENTION

1. Field of the Invention

The present invention relates to a door locking system for a motor vehicle which locks and unlocks a door lock such as a trunk lid lock or a tailgate lock by motor power or manual power.

2. Description of the Prior Art

In a typical door locking system for car doors including a trunk lid and a tailgate, a striker is fixed to one of a car body and a car door, a base plate having a striker leading slot is fixed to the other of the car body and the car door, and a latch and a pawl for locking and unlocking the striker are pivoted on the base plate on opposite sides of the striker leading slot, respectively.

A typical door locking system is conventionally provided with a powered operation device and a manual operation device. The powered operation device is provided with a rotary pressing member which is driven by a motor to press the pawl so that it rotates in a lock releasing direction to disengage the latch so that the latch releases from the striker. The manual operation device is provided with an opening lever which is engaged with the pawl to rotate the pawl in the lock releasing direction by a manual operation. The opening lever is conventionally provided as a member independent of the rotary pressing member. This means that the rotary pressing member and the opening lever are respectively pivoted about different rotational shafts. This structure increases the number of elements and the size of the door locking system. Moreover, due to this structure, the direction in which load is applied to the rotational shaft of the pawl when the pawl is rotated by the rotary pressing member is different from the direction in which load is applied to the rotational shaft of the pawl when the pawl is rotated by the opening lever. This cannot ensure a smooth movement of the pawl because the pawl is pressed by the rotary pressing member and the opening lever from different directions.

In addition, in the conventional door locking system, since the rotary pressing member is supported by the base plate to be freely rotatable, it is necessary to provide the door locking system with an independent rotational shaft about which the rotary pressing member is freely rotatable. Providing such an independent rotational shaft causes a problem in the positioning accuracy between the independent rotational shaft and associated elements, an increase in the number of elements of the door locking system, and an increase in the number of man-hours for assembly.

Moreover, in typical power door locking systems, the rotary pressing member applies pressure to the pawl via a roller which is rotatably fixed to the pawl at a point thereon which comes into contact with the rotary pressing member when the rotary pressing member applies pressure to the pawl. Providing the pawl with such a roller that is provided as an element independent of the pawl causes a problem in the positioning accuracy between the pawl and the roller, increases the number of elements of the power door locking system, and increases the number of man-hours for assembly.

On the other hand, typical door locking systems are generally provided with a luggage compartment lamp switch which turns ON and OFF a luggage compartment lamp when a trunk lid lock or a tailgate lock is unlocked and locked, respectively. The luggage compartment lamp switch includes a stationary terminal strip serving as one of positive and negative electrodes of the luggage compartment lamp switch, and a movable terminal strip serving as the other of positive and negative electrodes of the luggage compartment lamp switch. The movable terminal strip is in contact with the stationary terminal strip when the locking system is in the lock release position in which the striker is disengaged from the latch, and the movable terminal strip is disengaged from the stationary terminal strip when the locking system is in the lock position in which the striker is engaged with the latch.

Conventionally, the structure providing electrical isolation between the stationary terminal strip and the movable terminal strip is complicated to prevent a malfunction from occurring, thus increasing the cost of production.

SUMMARY OF THE INVENTION

The present invention provides a door locking system for a motor vehicle which makes it possible to simplify the support structure for supporting a rotary pressing member with high positioning accuracy, and to reduce the number of elements of the door locking system and the number of man-hours for assembly.

The present invention provides a door locking system for a motor vehicle which makes it possible to simplify the support structure for supporting the opening lever which is operated when a door lock (e.g., a trunk lid lock or a tailgate lock) is manually unlocked.

The present invention provides a door locking system for a motor vehicle which makes it possible to simplify the mechanism around the pawl and to reduce the number of elements of the door locking system and the number of man-hours for assembly.

The present invention provides a door locking system for a motor vehicle which incorporates a luggage compartment lamp switch having a cost-reduced structure.

The present invention provides a door locking system for a motor vehicle which incorporates a luggage compartment lamp switch, wherein the door locking system includes a rotary pressing member which is driven by motor to press the pawl to unlock a door lock (e.g., a trunk lid lock or a tailgate lock), and wherein a power supply circuit and terminals thereof for supplying power to the motor and a switching circuit and terminal thereof for the luggage compartment lamp switch can be constructed easily in an efficient manner.

According to an aspect of the present invention, a door locking system for a motor vehicle is provided, including a striker fixed to one of a car body and a car door, a base plate fixed to the other of the car body and the car door, the base plate having a striker leading slot in which the striker is removably insertable, a latch for latching the striker, the latch being pivoted on the base plate on one of opposite sides of the striker leading slot, a pawl for locking and unlocking the latch, the pawl being pivoted on the base plate on the other of the opposite sides of the striker leading slot, a rotary pressing member driven by a motor to rotate the pawl in a lock release direction to disengage the latch so that the latch releases the striker, and a rotatable opening lever which is rotated by a manual operation to rotate the pawl in the lock release direction to disengage the latch. The rotary pressing member and the rotatable opening lever are pivoted about a common rotational shaft.

It is desirable for the door locking system to include a motor housing for housing the motor, the motor housing being made of synthetic resin mold. The rotational shaft is formed integral with the motor housing. The base plate includes a support portion which supports a tip of the rotational shaft to be supported by the base plate when the motor housing is fixed to the base plate.

The support portion of the base plate can include a support hole into which a tip of the rotational shaft is fitted.

The opening lever can be supported on the rotational shaft to be held between the base plate and the rotary pressing member.

The tip of the rotational shaft can include a small-diameter tip portion, and the opening lever can be supported on the rotational shaft to be held between the base plate and an annular stepped portion formed around the base of the small-diameter tip portion.

The support portion of the base plate can include a support boss into which a hole formed on the tip of the rotational shaft is fitted. It is desirable for the rotary pressing member and the rotatable opening lever to be rotatable relative to each other about the rotational shaft.

It is desirable for the rotary pressing member to come into contact with an engaging portion of the pawl to press the engaging portion when the rotary pressing member rotates the pawl in the lock release direction, the engaging portion being formed as a bent engaging portion.

The rotary pressing member can include a lock release cam, a cam surface of which is shaped so that a distance between the cam surface and an axis of rotation of the rotary pressing member increases gradually.

The bent engaging portion can include a linear portion which extends in a radial direction of the axis of rotation of the pawl, and an inclined portion which extends obliquely with respect to the linear portion from an end of the linear portion. The cam surface of the lock release cam first presses the inclined portion and subsequently presses the linear portion when the rotary pressing member rotates the pawl in the lock release direction to disengage the latch from the striker.

It is desirable for the rotary pressing member and the rotatable opening lever to be freely rotatable about the rotational shaft relative to each other. The rotatable opening lever comes into contact with the linear portion to press the linear portion when the rotatable opening lever rotates the pawl in the lock release direction.

It is desirable for the cam surface of the lock release cam to be shaped so that the distance between the cam surface and the axis of rotation of the rotary pressing member increases gradually in a rotational direction thereof.

The door locking system can include a luggage compartment lamp switch having a stationary terminal strip serving as a positive electrode and a movable terminal strip serving as a negative electrode. The movable terminal strip is in contact with the stationary terminal strip when the striker is disengaged from the latch. The movable terminal strip is disengaged from the stationary terminal strip when the striker is engaged with the latch.

The door locking system includes a motor housing for housing the motor, the motor housing being fixed to the base plate. One end of the movable terminal strip is fixed to the motor housing.

The door locking system can include a pair of terminal strips for supplying power to the motor. The pair of terminal strips and the stationary terminal strip are formed integral with the motor housing by insertion molding. One of the pair of terminal strips which serves as a negative electrode is electrically connected with the movable terminal strip.

It is desirable for the one end of the movable terminal strip and the one of the pair of terminal strips to be fixed to the base plate by a set screw which is also used to fix the motor housing to the base plate.

The motor housing can include a holding device for temporarily holding the movable terminal strip before the motor housing is fixed to the base plate.

It is desirable for the holding device to include a groove provided on the motor housing in which the one end of the movable terminal strip that is fixed to the motor housing is positioned, and two protrusions formed on the motor housing on opposite side surfaces of the groove to hold a portion of the movable terminal strip in the vicinity of the one end of the movable terminal strip between the two protrusions.

The car door can be a trunk lid or a tailgate.

It is desirable for the rotary pressing member to include a worm gear which is engaged with a worm gear of a worm on a rotary shaft of the motor.

The door locking system can include a biasing member for biasing the rotary pressing member in a rotational direction opposite to a rotational direction in which the rotary pressing member is driven by the motor.

The biasing member can be a torsion coil spring installed between the motor housing and the rotary pressing member around the rotational shaft.

It is desirable for the door locking system to include a spring for biasing the pawl and the latch to rotate in opposite rotational directions so as to engage with each other.

In another embodiment, a door locking system for a motor vehicle is provided, including a striker fixed to one of a car body and a car door, a base plate fixed to the other of the car body and the car door, the base plate having a striker leading slot in which the striker is removably insertable, a latch for latching the striker, the latch being pivoted on the base plate on one of opposite sides of the striker leading slot, a pawl for locking and unlocking the latch, the pawl being pivoted on the base plate on the other of the opposite sides of the striker leading slot, a motor which rotates a worm fixed to a rotary shaft of the motor, a cam-integrated worm wheel associated with the worm to be driven by the motor, wherein a lock release cam formed integral with the cam-integrated worm wheel presses the pawl to rotate the pawl in a lock release direction to disengage the latch so that the latch releases the striker when the cam-integrated worm wheel is driven by the motor, and a rotatable opening lever which is rotated by a manual operation to rotate the pawl in the lock release direction to disengage the latch so that the latch releases the striker. The cam-integrated worm wheel and the rotatable opening lever are pivoted about a common rotational shaft.

The present disclosure relates to subject matter contained in Japanese Patent Application Nos. 2001-386436 (filed on Dec. 19, 2001), 2001-386437 (filed on Dec. 19, 2001) and 2001-386438 (filed on Dec. 19, 2001) which are expressly incorporated herein by reference in their entireties.

BRIEF DESCRIPTION OF THE DRAWINGS

The present invention will be described below in detail with reference to the accompanying drawings, in which:

FIG. 11 is a view similar to that of FIG. 10, showing the luggage compartment lamp switching circuit in a state where the luggage compartment lamp switch is ON;

DESCRIPTION OF THE PREFERRED EMBODIMENT

The general structure of an embodiment of a motor vehicle door locking system 11 according to the present invention will be discussed hereinafter.

Figure 1:
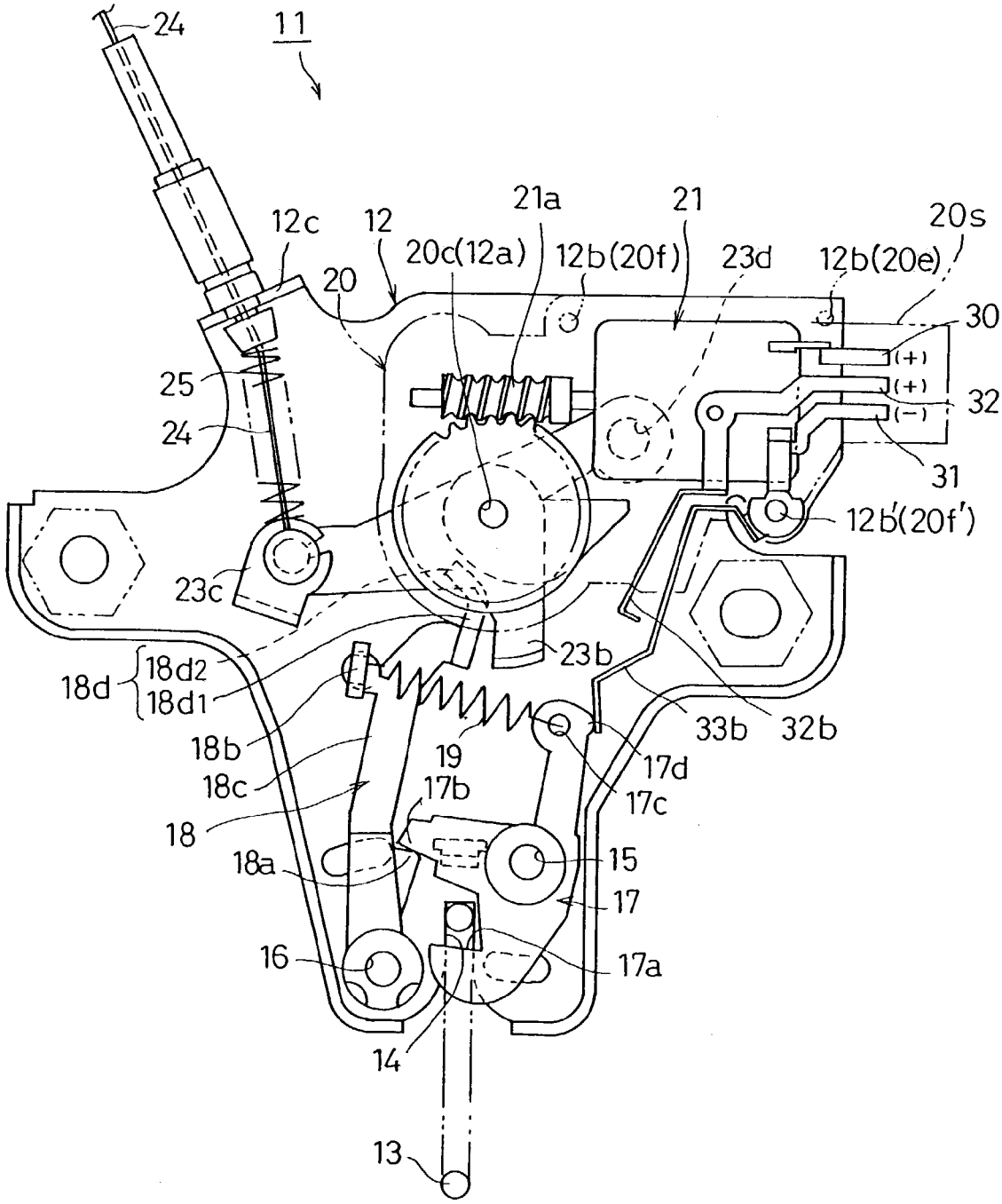
FIG. 1 is a front elevational view, partly developed, of an embodiment of a door locking system for a motor vehicle according to the present invention.
Figure 2:
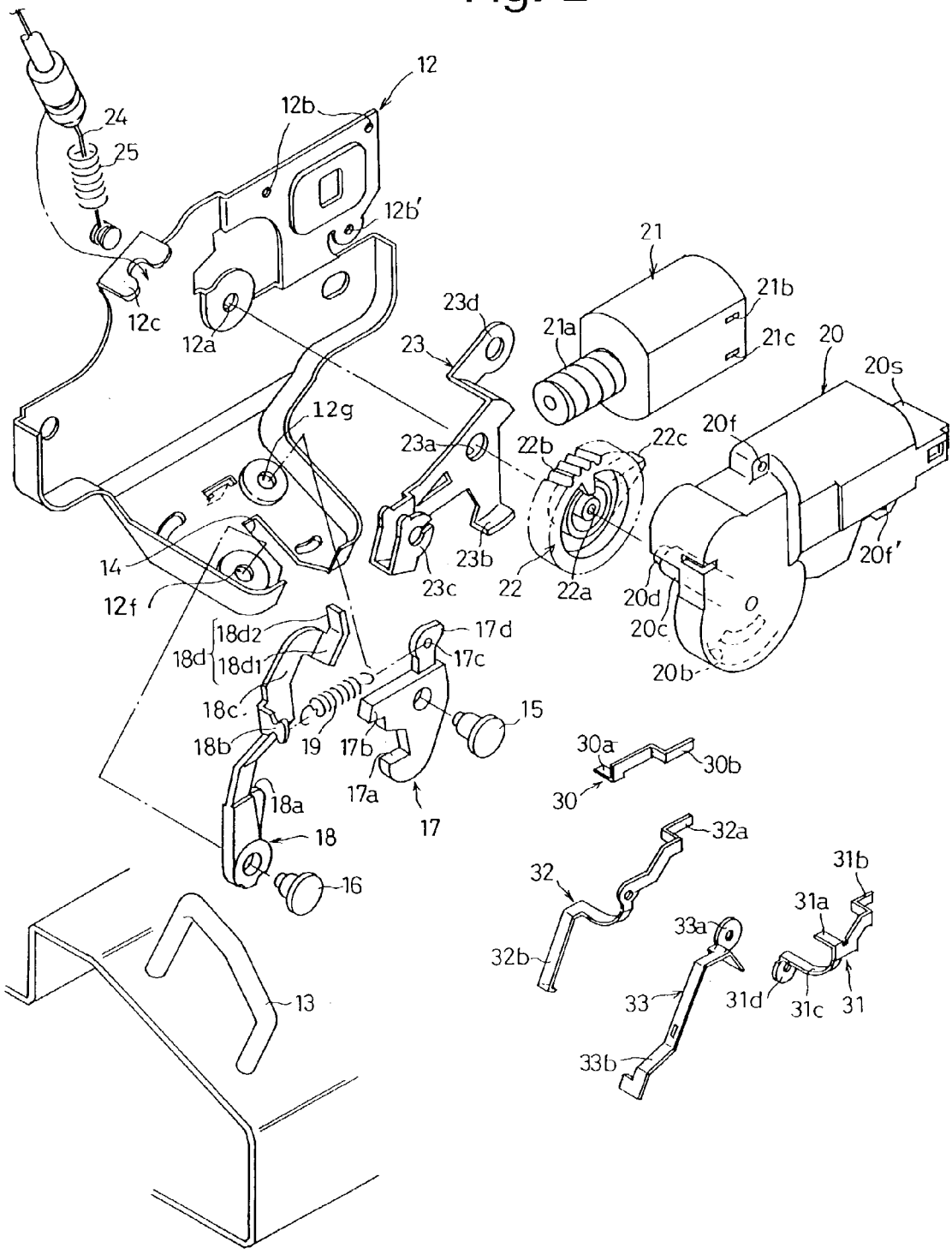
FIG. 2 is an exploded perspective view of the door locking system shown in FIG. 1.

The motor vehicle door locking system 11 serves as a trunk-lid locking system for locking the trunk lid of a motor vehicle. As shown in FIGS. 1 and 2, a base plate 12 made of conductive metal is fixed to one of the trunk lid and the car body of the trunk lid while a striker 13 is fixed to the other of the trunk lid and the car body of the trunk lid. For instance, in the present embodiment, the metal base plate 12 is fixed to the car body while the striker 13 is fixed to the trunk lid. The base plate 12 is provided with a striker leading slot 14. The motor vehicle door locking system 11 is provided with a latch 17 and a pawl 18 which are pivoted on the metal base plate 12 at opposite sides of the striker leading slot 14, respectively.

The latch 17 is provided with a striker holding groove 17*a*, an engaging portion 17*b*, a spring-engaging hole 17*c* and a switch lever pressing portion 17*d*. The pawl 18 is provided with a locking portion 18*a* which is engageable with the engaging portion 17*b*, a spring-engaging hook portion 18*b* and a driven arm portion 18*c*. The pawl 18 is pivoted on a pivot pin 16 fixed to a support hole 12*f* (see FIG. 2) formed on the base plate 12, and the latch 17 is pivoted on a pivot pin 15 fixed to another support hole 12*g* (see FIG. 2) formed on the base plate 12. One end of an extension coil spring 19 is hooked through the spring-engaging hole 17*c* while the other end of the extension coil spring 19 is hooked over the spring-engaging hook portion 18*b* to bias the latch 17 and the pawl 18 to rotate in opposite rotational directions to make the engaging portion 17*b* and the locking portion 18*a* engage with each other. In a locked state shown in FIG. 1 where the engaging portion 17*b* of the latch 17 is engaged with the locking portion 18*a* of the pawl 18, the latch 17 is engaged with the striker 13 with the striker 13 held in the striker holding groove 17*a* and the striker leading slot 14. In this locked state, disengaging the locking portion 18*a* of the pawl 18 from the engaging portion 17*b* of the latch 17 causes the latch 17 to rotate about the pivot pin 15 in a rotational direction (counterclockwise as viewed in FIG. 1) by the spring force of the extension coil spring 19 to disengage the latch 17 from the striker 13 to thereby allow the striker 13 to move out of the striker leading slot 14 and the striker holding groove 17*a*.

Figure 3:
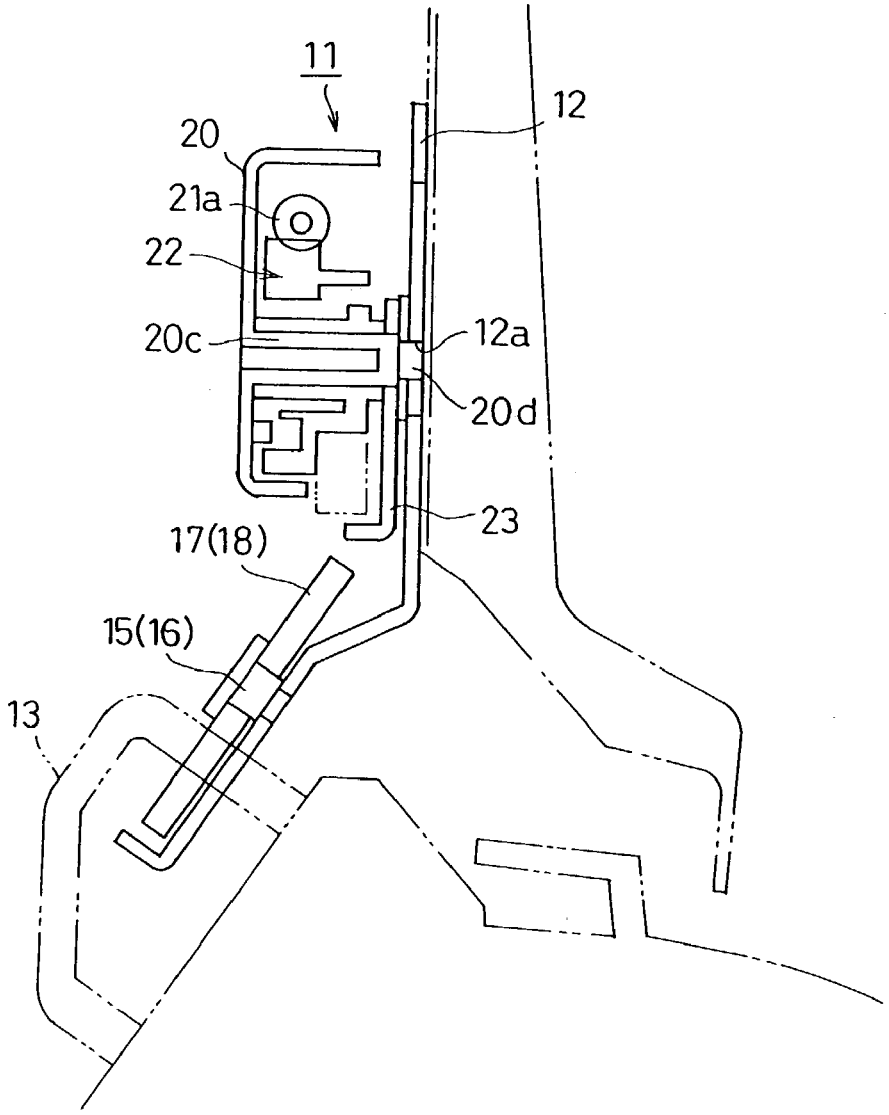
FIG. 3 is a longitudinal sectional view of the door locking system shown in FIG. 1.

The motor vehicle door locking system 11 is provided with a motor housing 20 molded from synthetic resin which is fixed to the base plate 12. As show in FIG. 4, the motor housing 20 is provided with a motor-unit accommodation recess 20*a*, a rotary-member accommodation recess 20*b*, and a rotational shaft 20*c* which projects from an inner surface of the rotary-member accommodation recess 20*b*. The motor vehicle door locking system 11 is provided in the rotary-member accommodation recess 20*b* with a motor unit 21 which is fixed to an inner surface of the rotary-member accommodation recess 20*b*. The motor unit 21 is provided with a worm 21*a* fixed onto a rotary shaft of the motor unit 21. The rotational shaft 20*c* is provided at the tip thereof with a small-diameter tip portion 20*d* (see FIGS. 2, 3 and 7) having a smaller diameter than the remaining part of the rotational shaft 20*c*. The rotational shaft 20*c* extends to the base plate 12 so that the small-diameter tip portion 20*d* is fitted into a support hole 12*a* formed on the base plate 12.

Figure 12:
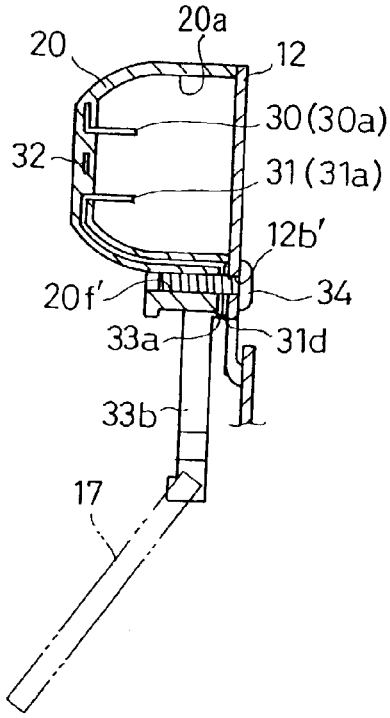
FIG. 12 is a cross sectional view taken along XII—XII line shown in FIG. 10.

The base plate 12 is provided with three engaging holes: two engaging holes 12*b* and an engaging hole 12*b*'. The motor housing 20 is provided with two screw holes: a screw hole 20*f* and a screw hole 20*f*' formed to correspond to corresponding one of the two engaging holes 12*b* (the left engaging hole 12*b* as viewed in FIG. 1) and the engaging hole 12*b*', respectively. The motor housing 20 is provided with a positioning protrusion 20*e* (see FIG. 4) which is engaged in corresponding one of the two engaging holes 12*b* (the right engaging hole 12*b* as viewed in FIG. 1). A set screw (not shown) is inserted in the left engaging hole 12*b* to be screwed into the screw hole 20*f*, and another set screw 34 (see FIG. 12) is inserted in the engaging hole 12*b*' to be screwed into the screw hole 20*f*'. Two negative terminal strips 31 and 33 are fixed to the base plate 12 by the set screw 34 that is screwed into the screw hole 20*f*' via the engaging hole 12*b*'.

A plate portion of the base plate 12 which has the striker leading slot 14 is angled relatively to another plate portion of the base plate 12 to which the motor housing 20 is fixed; i.e., these two plate portions do not lie in a plane. Although each of the latch 17 and the pawl 18 has a bent portion to correspond to the shape of the base plate 12, each of the latch 17 and the pawl 18 is illustrated as having no bent portion in the drawings for the purpose of illustration.

Figure 6:
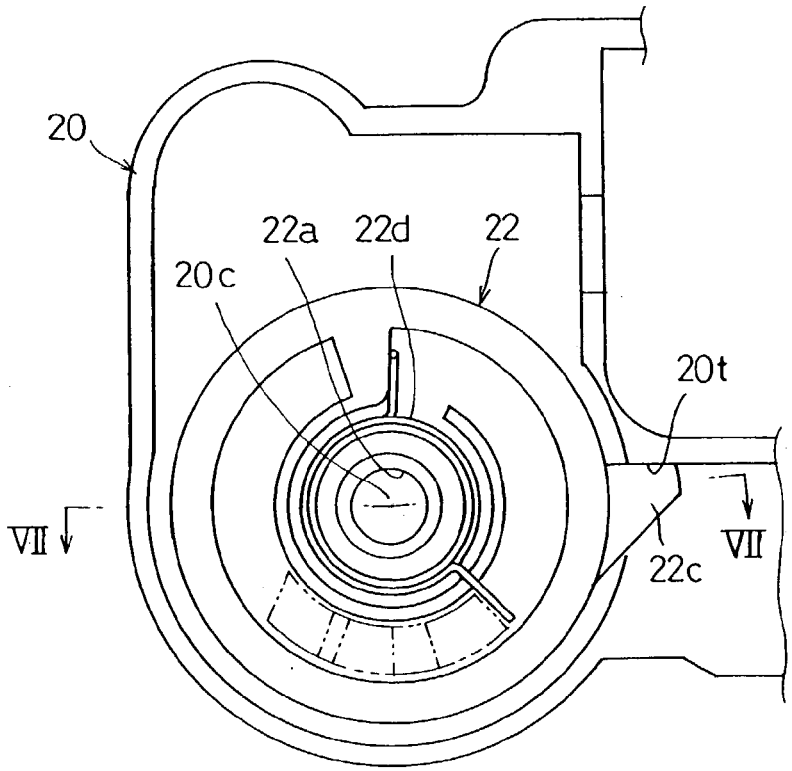
FIG. 6 is a rear elevational view of a cam-integrated worm wheel and a portion of the motor housing of the door locking system shown in FIG. 1.
Figure 7:
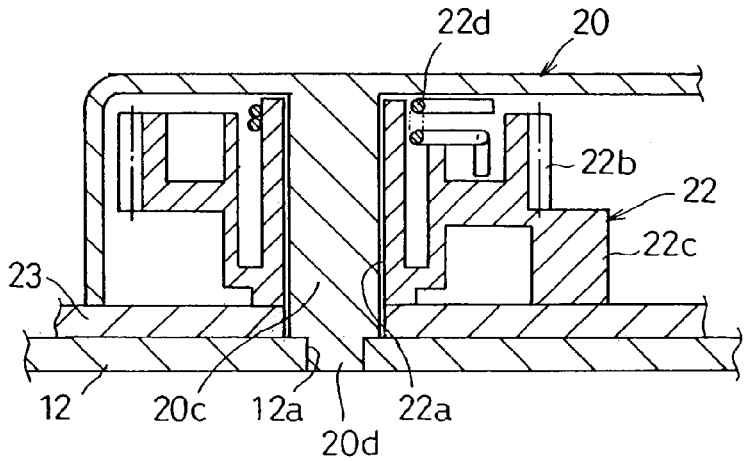
FIG. 7 is a cross sectional view taken along VII—VII line shown in FIG. 6.

The motor vehicle door locking system 11 is provided on the rotational shaft 20*c* with a cam-integrated worm wheel (pawl pressing rotary member) 22 and an opening lever 23 so that the cam-integrated worm wheel 22 and the opening lever 23 can freely rotate about the rotational shaft 20*c* relative to each other. As shown in FIGS. 6 and 7, the cam-integrated worm wheel 22 is provided with an axial hole 22*a* in which the rotational shaft 20*c* of the motor housing 20 is rotatably fitted, a worm gear 22*b* which is engaged with a worm gear of the worm 21*a* of the motor unit 21, and a lock release cam 22*c*. The worm gear 22*b* and the lock release cam 22*c* are formed integral with each other. The lock release cam 22*c* has a cam surface which is shaped so that the distance between the cam surface and the axial hole 22*a* increases gradually in a counterclockwise direction as viewed in FIG. 1 or a clockwise direction as viewed in FIG. 4.

The opening lever 23 is provided with a pivot hole 23*a* in which the rotational shaft 20*c* of the motor housing 20 is rotatably fitted, a lock release arm 23*b*, a cable hooking arm 23*c* and a rod coupling arm 23*d*. A tip of an opener cable 24, which is drawn when an associated lock release manual lever (not shown) installed in the inside of the car is manually pulled, is fixed to the wire hooking arm 23*c*. A lock rod (not shown), which is pulled when a key-operated trunk lid lock (not shown) is opened with a key, is coupled to the rod coupling arm 23*d*.

Each of the lock release cam 22*c* of the cam-integrated worm wheel 22 and the lock release arm 23*b* of the opening lever 23 can be engaged with and disengaged from a bent engaging portion 18*d* which is formed at the tip (free end) of the driven arm portion 18*c* of the pawl 18. The bent engaging portion 18*d* is composed of two parts: a linear portion 18*d*1 and an inclined portion 18*d*2. The linear portion 18*d*1 is pressed by the lock release cam 22*c* of the cam-integrated worm wheel 22 or the lock release arm 23*b* of the opening lever 23. The inclined portion 18*d*2 is pressed only by the lock release cam 22*c*. The linear portion 18*d*1 is pressed by the lock release arm 23*b* in a direction to rotate the pawl 18 counterclockwise as viewed in FIG. 1 if the opening lever 23 is pulled by the opener cable 24 via the wire hooking arm 23*c* or by the lock rod via the rod coupling arm 23*d* to rotate clockwise as viewed in FIG. 1.

The base plate 12 is provided with a bent portion 12*c* so that a compressed coil spring 25 is installed between the bent portion 12*c* and the wire hooking arm 23*c* of the opening lever 23. The compressed coil spring 25 biases the opening lever 23 in a direction (returning direction) of moving the lock release arm 23*b* away from the driven arm portion 18*c* of the pawl 18, i.e., counterclockwise as viewed in FIG. 1. The opening lever 23 abuts against a stop (not shown) when positioned at an initial position; namely, the stop determines the initial position of the opening lever 23. A torsion coil spring 22*d* (see FIGS. 6 and 7) is installed between the motor housing 20 and the cam-integrated worm wheel 22 around the axial hole 22*a* to bias the cam-integrated worm wheel 22 counterclockwise as viewed in FIGS. 1 and 2. The lock release cam 22*c* of the cam-integrated worm wheel 22 abuts against a stop wall 20*t* (see FIG. 6) of the motor housing 20 when the cam-integrated worm wheel 22 fully rotates counterclockwise as viewed in FIG. 6 to a rotational extremity of the cam-integrated worm wheel 22. When the cam-integrated worm wheel 22 is in the rotational extremity as shown in FIG. 6, the lock release cam 22*c* of the cam-integrated worm wheel 22 is in a disengaged position thereof where the lock release cam 22*c* is disengaged from the bent engaging portion 18*d* of the pawl 18.

Figure 8A:
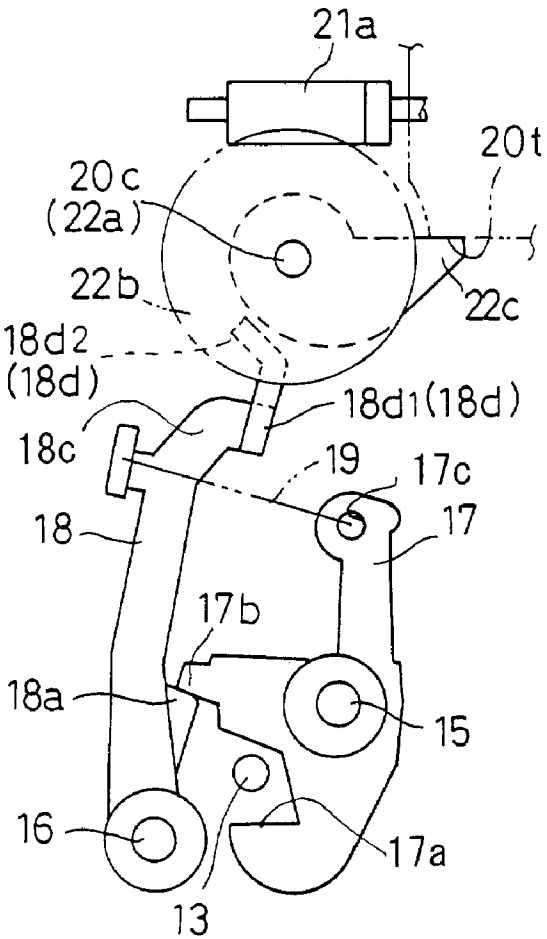
FIG. 8A is a front elevational view of fundamental elements of the door locking system shown in FIG. 1, showing a locked state where a pawl is engaged with a latch and where the pawl is disengaged from a lock release cam of the cam-integrated worm wheel.
Figure 8B:
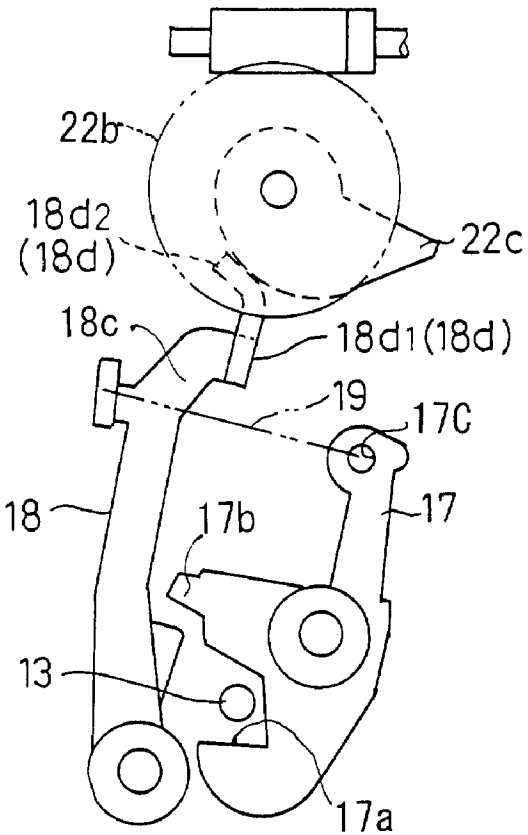
FIG. 8B is a view similar to that of FIG. 8A, showing a transitional state between the locked state shown in FIG. 8A and an unlocked state shown in FIG. 8C.
Figure 8C:
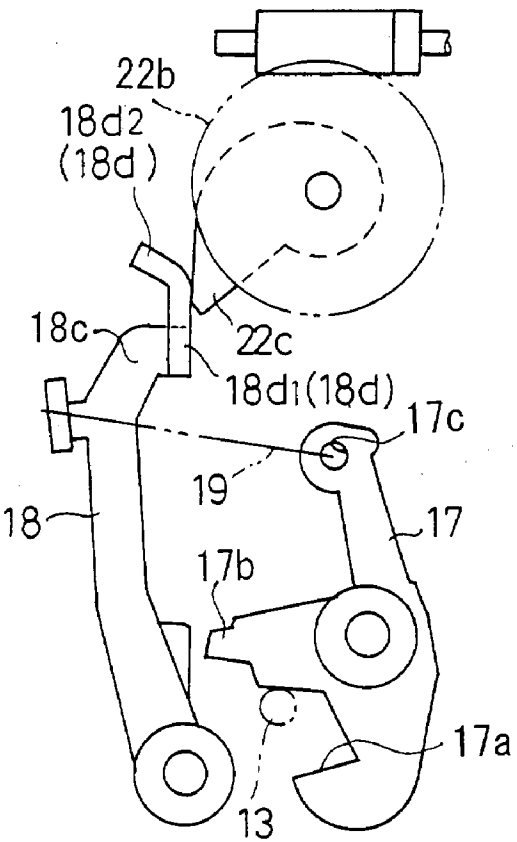
FIG. 8C is a view similar to that of FIG. 8A, showing an unlocked state where the pawl is rotated counterclockwise by a clockwise rotation of the lock release cam of the cam-integrated worm wheel to be disengaged from the latch.
Figure 9:
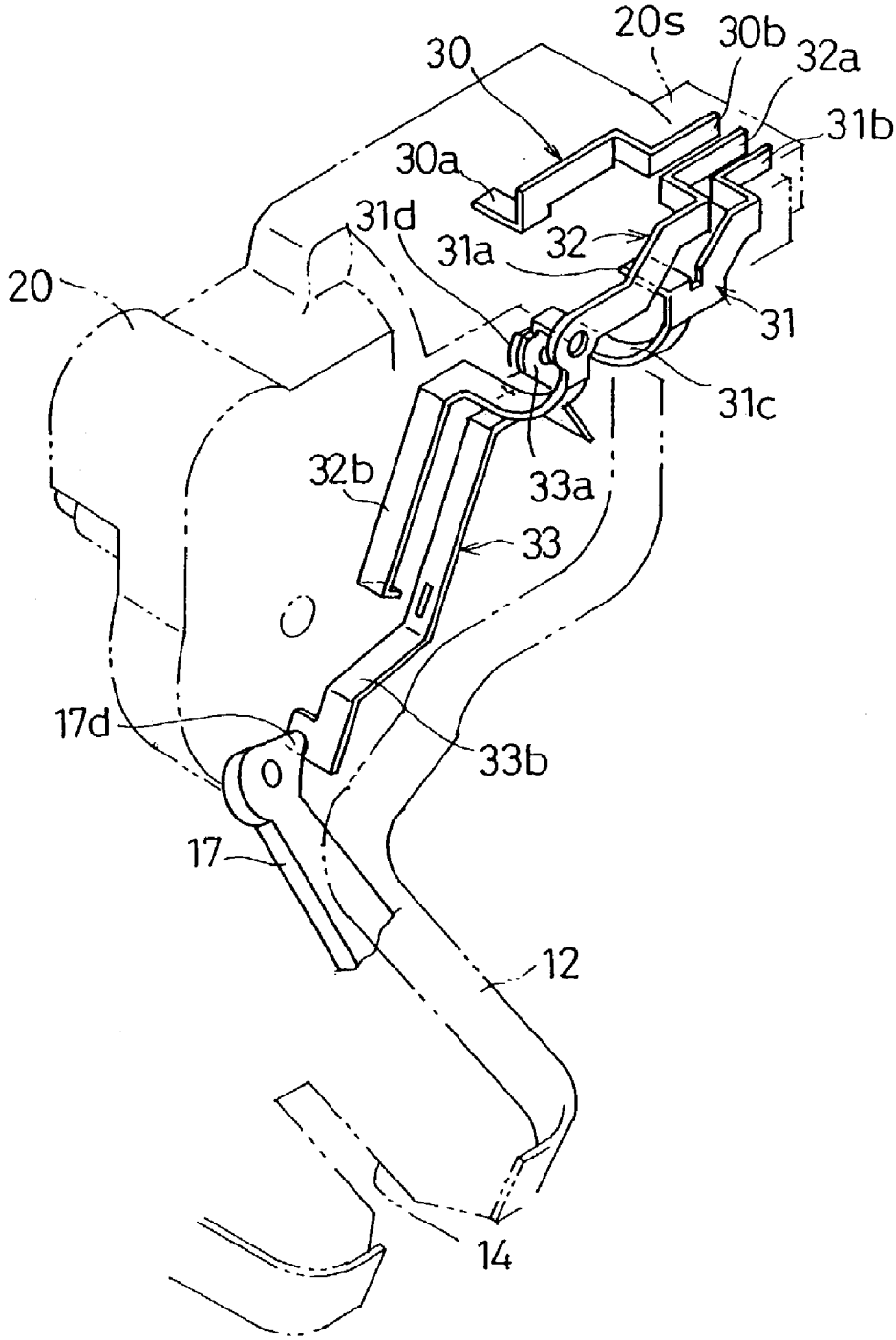
FIG. 9 is a perspective view of a pair of terminal strips of a power supply circuit for supplying power to a motor unit and another pair of terminal strips of a switching circuit for supplying power to a luggage compartment lamp.
Figure 10:
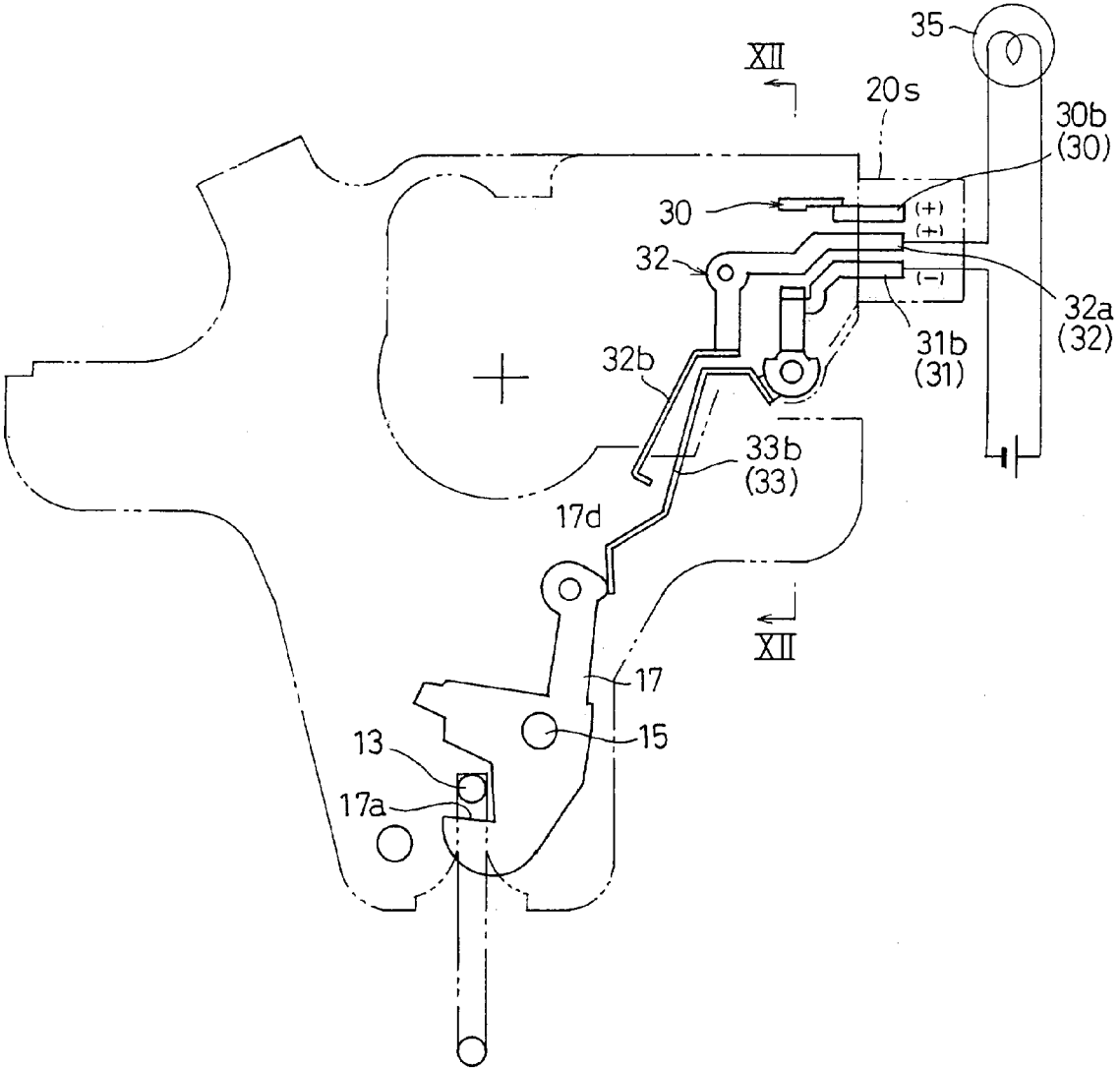
FIG. 10 shows an arrangement of the two pairs of terminal strips shown in FIG. 9 in relation to the latch, showing the luggage compartment lamp switching circuit in a state where a luggage compartment lamp switch is OFF.

If power is supplied to the motor unit 21 to rotate the worm gear 22*b* via the worm 21*a* clockwise as viewed in FIGS. 1, 8A, 8B and 8C in response to a signal (e.g., a lock-release wireless signal), the bent engaging portion 18*d* of the pawl 18 is pressed by the lock release cam 22*c*, which is formed integral with the worm gear 22*b*, in a direction to rotate the pawl 18 counterclockwise as viewed in FIG. 1 (see FIGS. 8A, 8B and 8C).

If the pawl 18 rotates about the pivot pin 16 counterclockwise as viewed in FIGS. 1, 8A, 8B and 8C via rotation of either the cam-integrated worm wheel 22 or the opening lever 23, the locking portion 18*a* of the pawl 18 is disengaged from the engaging portion 17*b* of the latch 17 to thereby allow the striker 13 to move out of the striker leading slot 14 and the striker holding groove 17*a*.

As shown in FIGS. 9 through 12, the motor housing 20 is provided with a positive terminal strip 30, a negative terminal strip 31 and a positive terminal strip (stationary terminal) 32. The positive terminal strip 30 and the negative terminal strip 31 are used to supply power to the motor unit 21. The positive terminal strip 32 is used to supply power to a luggage compartment lamp 35 (see FIGS. 10 and 11) of the car. These three terminal strips 30, 31 and 32 are formed integral with the motor housing 20 by insertion molding. One end of the positive terminal strip 30 projects into the motor-unit accommodation recess 20*a* (see FIGS. 4 and 12) to be formed as a motor-side positive contact 30*a* which is inserted into a positive contact slot 21*b* (see FIG. 2) of the motor unit 21, and the other end of the positive terminal strip 30 projects into the inside of a female connector portion 20*s* of the motor housing 20 to be formed as a positive connecting contact 30*b*. The female connector portion 20*s* is formed integral with the motor housing 20. A middle portion of the negative terminal strip 31 projects into the motor-unit accommodation recess 20*a* (see FIGS. 4 and 12) to be formed as a motor-side negative contact 31*a* which is inserted into a negative contact slot 21*c* (see FIG. 2) of the motor unit 21, and one end of the negative terminal strip 31 projects into the inside of the female connector portion 20*s* of the motor housing 20 to be formed as a negative connecting contact 31*b*. The negative terminal strip 31 is provided with an extension portion 31*c* for the luggage compartment lamp 35. The extension portion 31*c* is provided at the tip thereof with a round terminal 31*d* having a circular hole which corresponds to the screw hole 20*f*' of the motor housing 20. The round terminal 31*d* is exposed to the outside of the motor housing 20 to be positioned on an outer surface of the motor housing 20 on the side of the base plate 12.

Figure 4:
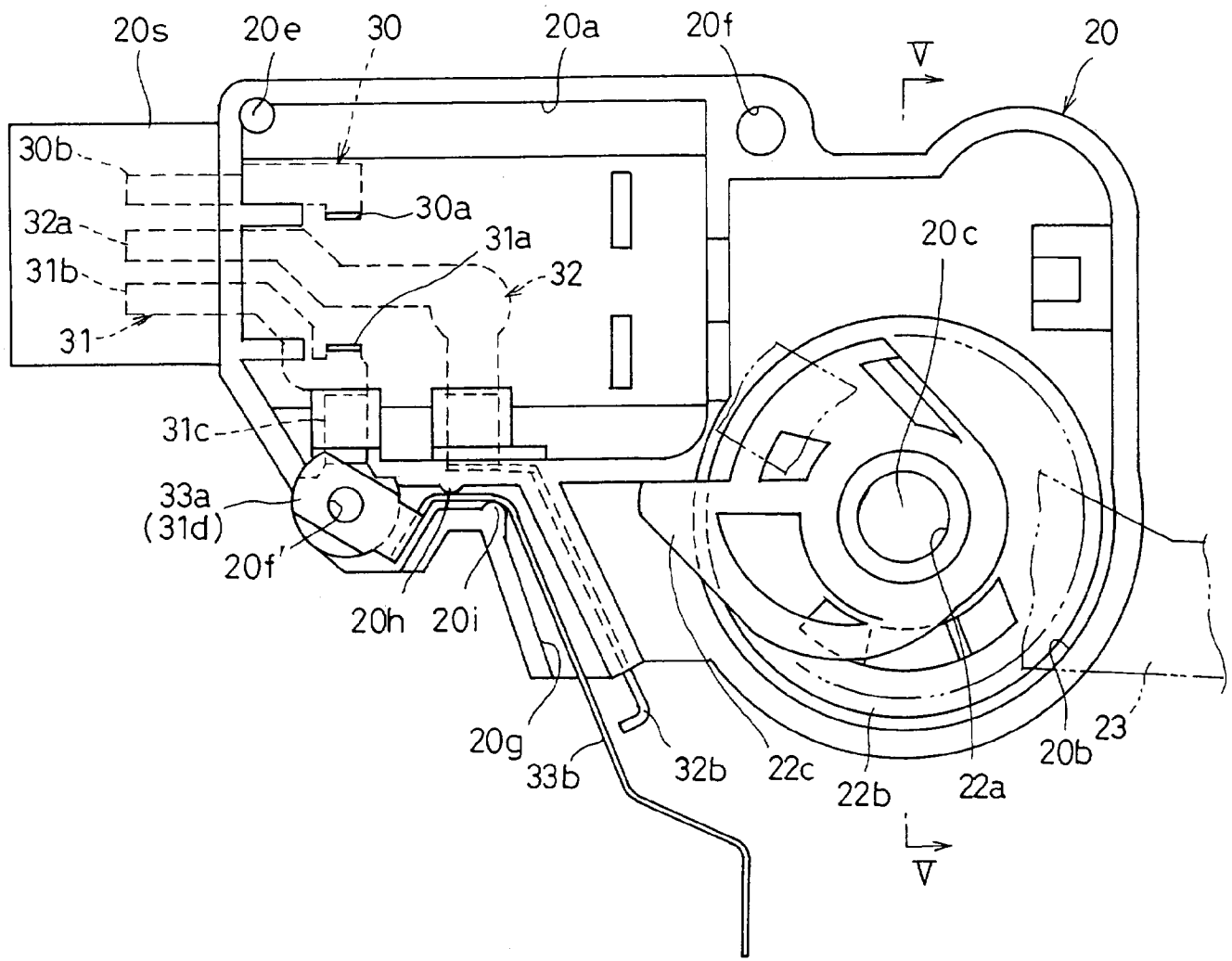
FIG. 4 is a rear elevational view of a motor housing of the door locking system shown in FIG. 1.
Figure 5:
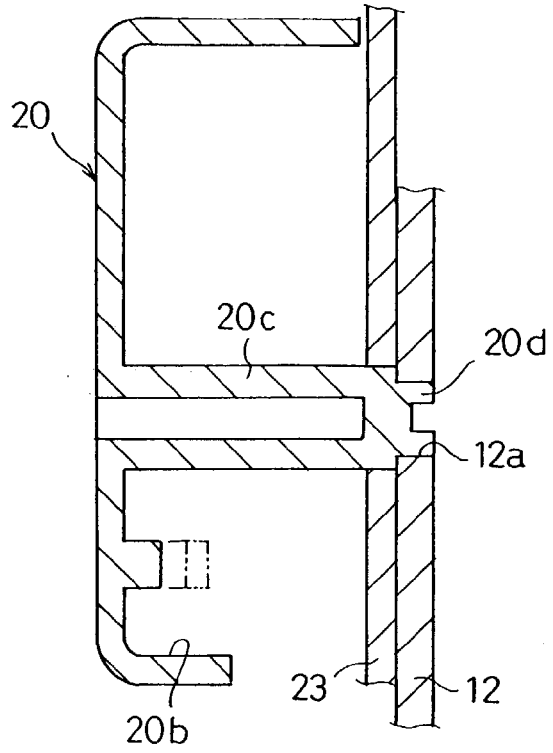
FIG. 5 is a cross sectional view taken along the V—V line shown in FIG. 4.

The motor vehicle door locking system 11 is provided with a movable negative terminal strip (movable terminal) 33 which is used together with the positive terminal strip 32 to supply power to the luggage compartment lamp 35. The positive terminal strip 32 and the movable negative terminal strip 33 constitute a leaf switch, wherein the movable negative terminal strip 33 serves as a semi-rigid leaf in which the major flexing occurs to contact with the positive terminal strip 32 when the switch is operated. One end of the movable negative terminal strip 33 is positioned between the base plate 12 at the engaging hole 12*b*' and the motor housing 20 at the screw hole 20*f*' to be fixed to the base plate 12 therebetween. More specifically, the movable negative terminal strip 33 is provided at one end thereof with a round terminal 33*a* having a circular hole which corresponds to the circular hole of the round terminal 31*d* of the negative terminal strip 31, and is further provided with a resilient arm portion 33*b* which extends from the round terminal 33*a* toward the latch 17. The round terminal 33*a* of the movable negative terminal strip 33 is positioned between the base plate 12 at the engaging hole 12*b*' and the screw hole 20*f*' of the motor housing 20, and is fixed to the base plate 12 by a set screw 34 (see FIG. 12) which is inserted in the engaging hole 12*b*' to be screwed into the screw hole 20*f*' with the round terminals 31*d* and 33*a* contacting each other. Accordingly, the negative terminal strip 31 and the movable negative terminal strip 33 are fixed to the base plate 12 to be grounded via the set screw 34 and the two round terminals 31*d* and 33*a*. As shown in FIG. 4, a fixed end portion of the resilient arm portion 33*b* is positioned in a swing-movement limit groove 20*g* formed on the motor housing 20 while a free end portion of the resilient arm portion 33*b* is positioned outside the motor housing 20. A portion of the movable negative terminal strip 33 in the vicinity of the round terminal 33*a* is held in between two protrusions 20*h* and 20*i* formed on the motor housing 20 on opposite side surfaces of the swing-movement limit groove 20*g* so that the portion of the movable negative terminal strip 33 in the vicinity of the round terminal 33*a* does not bend resiliently in the swing-movement limit groove 20*g*. The swing-movement limit groove 20*g* and the two protrusions 20*h* and 20*i* constitute a holding device and are effectively used to temporarily hold the movable negative terminal strip 33 on the motor housing 20 before the motor housing 20 is fixed to the base plate 12.

Figure 11:
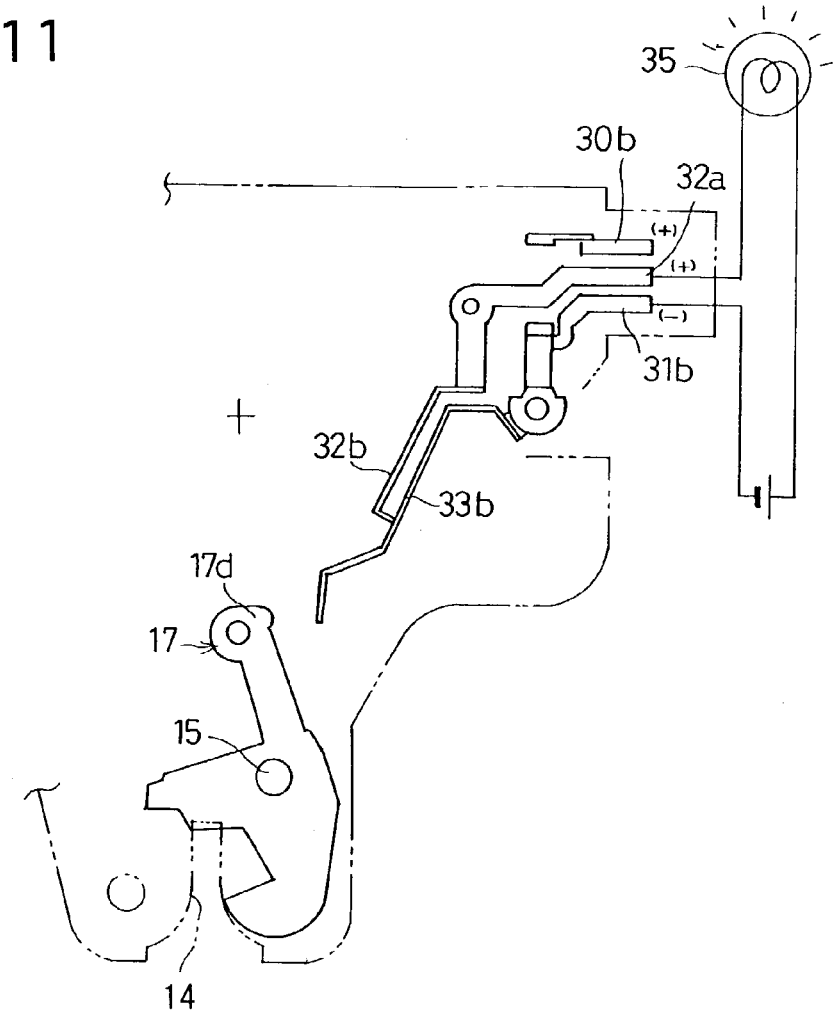

The resilient arm portion 33*b* of the movable negative terminal strip 33 extends toward the switch lever pressing portion 17*d* of the latch 17. The latch 17 rotates about the pivot pin 15 clockwise and counterclockwise as viewed in FIG. 1 when the trunk lid is locked and unlocked, respectively. When the latch 17 is in the lock position (the position shown in FIG. 1), the switch lever pressing portion 17*d* of the latch 17 presses the resilient arm portion 33*b* of the movable negative terminal strip 33 rightwards as viewed in FIG. 1 to resiliently bend the resilient arm portion 33*b* about the protrusion 20*i* in the same direction. In this state, the resilient arm portion 33*b* is not in contact with the positive terminal strip 32 as shown in FIG. 1. When the latch 17 is in the unlock position (the position shown in FIG. 11), the switch lever pressing portion 17*d* of the latch 17 does not press against the resilient arm portion 33*b* of the movable negative terminal strip 33, so that the resilient arm portion 33*b* is not resiliently bent. In this state, the resilient arm portion 33*b* is in contact with the positive terminal strip (stationary contact) 32 as shown in FIG. 11.

One end of the positive terminal strip 32 for the luggage compartment lamp 35, which is formed integral with the motor housing 20 by insertion molding as described above, projects into the inside of the female connector portion 20*s* of the motor housing 20 to be formed as a positive connecting contact 32*a*, and the other end of the positive terminal strip 32 is extended to a stationary position to serve as a stationary contact 32*b* with which the resilient arm portion 33*b* contacts when the switch lever pressing portion 17*d* of the latch 17 does not press against the resilient arm portion 33*b*. Namely, the resilient arm portion 33*b* contacts with the stationary contact 32*b* when in a free state, i.e., when the latch 17 is in the unlock position (see FIG. 11), and the resilient arm portion 33*b* resiliently bends to be disengaged from the stationary contact 32*b* when the latch 17 is in the lock position (see FIG. 10).

A male connector (not shown) is plugged into the female connector portion 20*s* of the motor housing 20 to connect a power supply circuit (not shown) between the positive connecting contact 30*b* and the negative connecting contact 31*b* to supply power to the motor unit 21. A luggage compartment lamp lighting circuit for lighting the luggage compartment lamp 35 is established between the negative connecting contact 31*b* and the positive connecting contact 32*a* (see FIGS. 10 and 11).

In the motor vehicle door locking system 11 having the above described structure, in a locked state shown in FIG. 1 where the engaging portion 17*b* of the latch 17 is engaged with the locking portion 18*a* of the pawl 18 while the striker 13 is held in the striker holding groove 17*a*, a rotation of the opening lever 23 clockwise as viewed in FIG. 1 by an operation of either the associated lock release manual lever via the cable hooking arm 23*c* or the key-operated trunk lid lock via the rod coupling arm 23*d*, causes the lock release arm 23*b* of the opening lever 23 to press against the linear portion 18*d*1 of the pawl 18 in a direction to rotate the pawl 18 counterclockwise as viewed in FIG. 1. This causes the locking portion 18*a* to be disengaged from the engaging portion 17*b* of the latch 17, which in turn causes the latch 17 to rotate about the pivot pin 15 counterclockwise as viewed in FIG. 1 by the spring force of the extension coil spring 19 to disengage the latch 17 from the striker 13 to thereby allow the striker 13 to move out of the striker leading slot 14 and the striker holding groove 17*a*. Once the opening lever 23 becomes free from a lock releasing force applied thereto, the opening lever 23 rotates counterclockwise as viewed in FIG. 1 to return to the initial rotational position thereof by the spring force of the compression coil spring 25.

Moreover, in a locked state shown in FIG. 1, if power is supplied to the motor unit 21 to rotate the worm 21*a* in response to a signal (e.g., a lock-release wireless signal), the worm wheel 22 rotates via the worm gear 22*b* clockwise as viewed in FIGS. 1, 8A, 8B and 8C against the spring force of the torsion coil spring 22*d*, the inclined portion 18*d*2 of the bent engaging portion 18*d* of the pawl 18 is pressed by the lock release cam 22*c* in a direction to rotate the pawl 18 counterclockwise as viewed in FIG. 1 to thereby allow the striker 13 to move out of the striker leading slot 14 and the striker holding groove 17*a*, in a similar manner as in the case where either the associated lock release manual lever or the key-operated trunk lid lock is operated.

Furthermore, in a locked state shown in FIG. 1, wherein the striker 13 is held in the striker holding groove 17*a*, the switch lever pressing portion 17*d* of the latch 17 presses against the resilient arm portion 33*b* of the movable negative terminal strip 33 for the luggage compartment lamp 35 so that the resilient arm portion 33*b* is disengaged from the stationary contact 32*b*. Accordingly, in the state shown in FIG. 1, no power is supplied to the luggage compartment lamp 35 so that the luggage compartment lamp 35 is not turned ON. However, in an unlocked state shown in FIG. 11, wherein the striker 13 is allowed to move out of the striker leading slot 14 and the striker holding groove 17*a*, the switch lever pressing portion 17*d* of the latch 17 is disengaged from the resilient arm portion 33*b* of the movable negative terminal strip 33 to free the resilient arm portion 33*b* from any external force. Accordingly, in the state shown in FIG. 11, the resilient arm portion 33*b* is in contact with the positive terminal strip 32 as shown in FIG. 11 so that power is supplied to the luggage compartment lamp 35. Consequently, the luggage compartment lamp 35 comes ON.

Features of the motor vehicle door locking system 11 will be discussed hereinafter.

In the above described embodiment of the motor vehicle door locking system, the rotational shaft 20*c* which supports the cam-integrated worm wheel 22 so as to freely rotate about the rotational shaft 20*c* is formed integral with the motor housing 20 that is molded from synthetic resin. Moreover, the opening lever 23 which is manually operated to disengage the pawl 18 from the latch 17 is supported by the rotational shaft 20*c* to be freely rotatable about the rotational shaft 20*c* relative to the cam-integrated worm wheel 22. Furthermore, in a state where the cam-integrated worm wheel 22 and the opening lever 23 are fitted on the rotational shaft 20*c* to be freely rotatable about the rotational shaft 20*c*, the motor housing 20 and the base plate 12 are fixed to each other by a set screw (not shown) which is inserted in corresponding one of the two engaging holes 12*b* to be screwed into the screw hole 20*f* and another set screw 34 which is inserted in the engaging hole 12*b*' to be screwed into the screw hole 20*f*' with the small-diameter tip portion 20*d* of the rotational shaft 20*c* and the positioning protrusion 20*e* being respectively fitted into the support hole 12*a* and the other engaging hole 12*b* of the base plate 12.

This structure wherein the rotational shaft 20*c* is formed integral with the motor housing 20 makes it possible to reduce the number of elements of the motor vehicle door locking system 11 and also the number of man-hours for assembly, and further makes it possible to raise the positioning accuracy between the rotational shaft 20*c* and associated elements of the door locking system 11. In addition, not only the supporting strength of the rotational shaft 20*c* but also the supporting strength of the motor housing 20 can be improved by the structure wherein the small-diameter tip portion 20*d* of the rotational shaft 20*c* is supported by the base plate 12 at the corresponding support hole 12*a*. Accordingly, the motor housing 20 together with the rotational shaft 20*c* can obtain a sufficient supporting strength even if the number of the screw holes 20*f* and 20*f*' and the number of the engaging holes 12*b* and 12*b*' are small.

Figure 13:
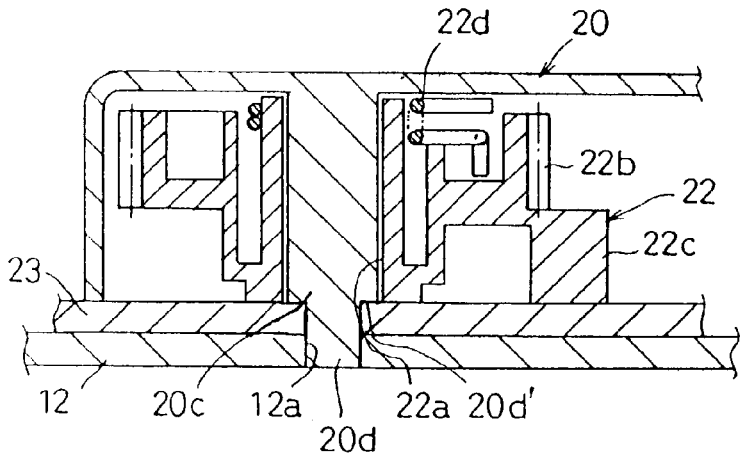
FIG. 13 is a view similar to that of FIG. 7, showing another embodiment of the structure supporting an opening lever of the door locking system shown in FIG. 1.

Regarding the supporting of the opening lever 23 that is fitted on the rotational shaft 20*c* to be freely rotatable about the rotational shaft 20*c*, the following two embodiments are possible: a first embodiment shown in FIG. 7 in which the opening lever 23 is supported on the rotational shaft 20*c* to be held between the base plate 12 and the cam-integrated worm wheel 22, and a second embodiment shown in FIG. 13 in which the opening lever 23 is supported on the rotational shaft 20*c* to be held between the base plate 12 and an annular stepped portion 20*d*' formed around the base of the small-diameter tip portion 20*d*. According to the first embodiment of supporting the opening lever 23, a sufficient strength of the rotational shaft 20*c* can be easily obtained. According to the second embodiment of supporting the opening lever 23, the opening lever 23 can be easily positioned in the right place in the axial direction. For instance, if the space between the annular stepped portion 20*d*' and the base plate 12 is set to be substantially equal to the thickness of the opening lever 23, axial play in the opening lever 23 is removed.

Figure 14:
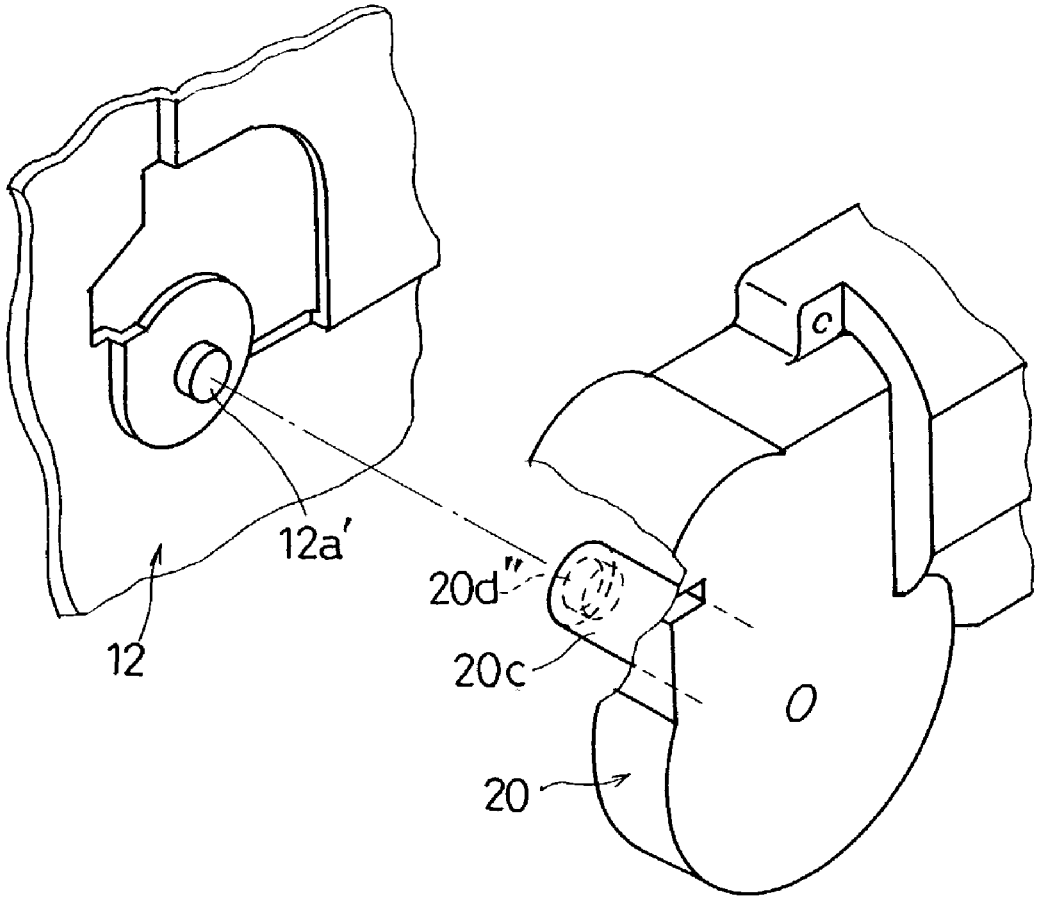
FIG. 14 is a view similar to a portion of FIG. 2, showing another embodiment of the structure supporting a rotational shaft on a base plate.

FIG. 14 shows an alternative embodiment for fitting the rotational shaft 20*c* of the motor housing 20 to the base plate 12. In this embodiment, a boss 12*a*' is provided on the base plate 12 instead of the support hole 12*a*, and a hole 20*d*' is provided in tip of the rotational shaft 20*c* instead of the small-diameter tip portion 20*d*. In this alternative, either structure shown in FIG. 7 or FIG. 13 can be employed. Namely, like the structure shown in FIG. 7, the opening lever 23 can be supported on the rotational shaft to be held between the base plate 12 and the cam-integrated worm wheel 22. Instead, like the structure shown in FIG. 13, an annular stepped portion (20*d*') can be formed at a tip of the rotational shaft 20*c* and the opening lever 23 can be supported on the rotational shaft 20*c* to be held between the base plate 12 and the annular stepped portion 20*d*'.

In the above described embodiment of the motor vehicle door locking system 11, the opening lever 23, which is used to be provided as a member independent of a cam-integrated worm wheel, and the cam-integrated worm wheel 22 are fitted coaxially on the rotational shaft 20*c* to be supported thereby. This structure makes it possible to reduce the number of elements of the motor vehicle door locking system 11 and also the number of man-hours for assembly.

The base plate 12 can also be used as a base plate used in a manual door locking system without using a motor such as the motor unit 21. In this case where the base plate 12 is used in a manual door locking system for a motor vehicle, the base plate 12 can be modified so that all the elements thereof associated with the motor housing 20 are removed from the base plate 12 and that a rotational shaft corresponding to the rotational shaft 20*c* is implanted into the support hole 12*a* of the base plate 12. A manually-operated opening lever and other members can be fitted on the implanted rotational shaft to be freely rotatable about the implanted rotational shaft relative to one another.

Although the cam-integrated worm wheel 22 serves as a rotary pressing member which presses the pawl 18 in the above described embodiment of the motor vehicle door locking system 11, the shape and the structure of the lock release cam 22*c* of the cam-integrated worm wheel 22 can be modified as needed. Moreover, the mechanism for giving rotation to the rotary pressing member which presses the pawl 18 is not limited solely to the above described particular mechanism.

As can be understood from the foregoing, according to the present invention, since the rotational shaft 20*c* on which the rotary pressing member is formed integral with the motor housing, the support structure for supporting the rotary pressing member is simplified with a high positioning accuracy while the number of elements of the door locking system and the number of man-hours for assembly are reduced.

In addition, the support structure for supporting the opening lever 23 is simplified by the structure wherein the opening lever 23 and the rotary pressing member are rotatably supported by the common rotational shaft 20*c* formed integral with the motor housing. This structure also ensures a smooth movement of the pawl 18 because the direction in which load is applied to the rotational shaft of the pawl 18 when the pawl 18 is rotated by a rotation of the rotary pressing member is identical to the direction in which load is applied to the rotational shaft 20*c* of the pawl 18 when the pawl 18 is rotated by a rotation of the opening lever 23.

In the above described embodiment of the motor vehicle door locking system 11, the bent engaging portion 18*d* is formed at the free end of the driven arm portion 18*c* as described above. The linear portion 18*d*1 of the bent engaging portion 18*d* extends in a radial direction of the axis of rotation (the pivot pin 16) of the pawl 18, while the inclined portion 18*d*2 of the bent engaging portion 18*d* extends obliquely from the tip of the linear portion 18*d*1. The linear portion 18*d*1 and the inclined portion 18*d*2 are formed integral with each other to have a smooth engaging surface extending over the linear portion 18*d*1 and the inclined portion 18*d*2. When the bent engaging portion 18*d* is pressed by the lock release cam 22*c*, that has a cam surface which is shaped so that the distance between the cam surface and the axial hole 22*a* increases gradually, the inclined portion 18*d*2 is pressed firstly by the lock release cam 22*c* and the linear portion 18*d*1 is pressed secondly by the lock release cam 22*c*. The lock release arm 23*b* of the opening lever 23 presses the linear portion 18*d*1.

Due to this structure, it is no longer necessary for the motor vehicle door locking system 11 to be provided with any conventional roller to be fixed to the pawl 18 because the engaging portion of the pawl 18, which comes into contact with the lock release cam 22*c* when the lock release cam 22*c* applies pressure to the pawl 18, is provided as the bent engaging portion 18*d* formed integral with the pawl 18. The positioning accuracy between the pawl 18 and the cam-integrated worm wheel 22 can be ensured by the positioning accuracy between the pivot pin 16, which is fixed to the support hole 12*f* on the base plate 12, and the rotational shaft 20*c*, which is fixed to the support hole 12*a* on the base plate 12. Since the pivot pin 16 and the rotational shaft 20*c* are fixed to the supporting holes 12*f* and 12*a* formed on a common plate, i.e. the base plate 12, the positioning accuracy between the pawl 18 and the cam-integrated worm wheel 22 is easily ensured.

The number of elements of the door locking system and the number of man-hours for assembly are reduced by the above described structure wherein the opening lever 23 is rotatably fitted on the rotational shaft 20*c* on which the cam-integrated worm wheel 22 is rotatably fitted, and further wherein the engaging portion of the pawl 18 which comes into contact with the lock release cam 22*c* when the lock release cam 22*c* applies pressure to the pawl 18 is provided as the bent engaging portion 18*d* formed integral with the pawl 18.

As can be understood from the foregoing, according to the present invention, the mechanism around the pawl 18 is simplified while the number of elements of the door locking system 11 and the number of man-hours for assembly are reduced because the engaging portion of the pawl 18 which comes into contact with the rotary pressing member is provided as a bent engaging portion (18*d*) formed integral with the pawl 18.

In addition, the support structure for supporting the opening lever 23 is simplified by the structure wherein the engaging portion of the pawl 18 which comes into contact with the opening lever 23, that is manually operated when the trunk lid is unlocked, is formed on a portion of the bent engaging portion 18*d* of the pawl 18.

In the above described embodiment of the motor vehicle door locking system 11, the positive terminal strip (stationary terminal) 32 and the movable negative terminal strip (movable terminal) 33 constitute one of positive and negative electrodes of the luggage compartment lamp switch and the other of positive and negative electrodes of the luggage compartment lamp switch, respectively. In addition, the movable negative terminal strip 33 is in contact with the stationary positive terminal strip 32 when the locking system 11 is in the lock release position in which the striker 13 is disengaged from the latch 17, and the movable negative terminal strip 33 is disengaged from the stationary positive terminal strip 32 when the locking system 11 is in the lock release position in which the striker 13 is engaged with the latch 17. In this structure, even if the movable negative terminal strip 33 contacts with peripheral conductive parts such as the base plate 12, no electrical problem or breakdown occurs because the base plate 12 is originally grounded and the movable negative terminal strip 33 is a negative terminal. Therefore, each of the movable negative terminal strip 33 and peripheral members which may contact with the movable negative terminal strip 33 does not need to have an electrical isolation structure. This reduces the cost of production.

In the above described embodiment of the motor vehicle door locking system, the cam-integrated worm wheel 22 for performing a lock release operation is driven by motor, and the motor housing 20 for housing the motor unit 21 is fixed to the base plate 12. In this structure, an end of the movable negative terminal strip 33, i.e., the round terminal 33*a* is fixed to the motor housing 20. This manner of fixing the movable negative terminal strip 33 to the motor housing 20 via one end of the movable negative terminal strip 33 simplifies the structure supporting the movable negative terminal strip 33.

In addition, the positive and negative terminal strips 30 and 31 (a pair of terminals for supplying power to the motor unit 21) and the positive terminal strip 32 (a positive terminal for supplying power to the luggage compartment lamp 35) are formed integral with the motor housing 20 by insertion molding while the movable negative terminal strip 33 (a negative terminal for supplying power to the luggage compartment lamp 35) is electrically connected to the negative terminal strip 31 via the round terminal 31*d* thereof. This structure wherein the three terminal strips 30, 31 and 32 are formed integral with the motor housing 20 by insertion molding and wherein a part of the movable negative terminal strip 33 for supplying power to the luggage compartment lamp 35 is shared between the movable negative terminal strip 33 and the negative terminal strip 31 simplifies the wiring structure of the motor vehicle door locking system 11.

Additionally, the round terminal 33*a* of the movable negative terminal strip 33 is fixed onto the round terminal 31*d* of the negative terminal strip 31 by the set screw 34 which is also used to fix the motor housing 20 onto the base plate 12. Due to this structure, the motor housing 20 and the movable negative terminal strip 33 is fixed to the base plate 12 at a time of fixing the motor housing 20 to the base plate 12. Furthermore, the movable negative terminal strip 33 can be easily fixed to the base plate 12 because a fixed end portion of the resilient arm portion 33*b* is positioned in the swing-movement limit groove 20*g* to be held in between the two protrusions 20*h* and 20*i* so as not to bend resiliently in the swing-movement limit groove 20*g* before the motor housing 20 is fixed to the base plate 12. Accordingly, the movable negative terminal strip 33 can be temporality held in the swing-movement limit groove 20*g* by the two protrusions 20*h* and 20*i* before the motor housing 20 is fixed to the base plate 12, which eases installation of the movable negative terminal strip 33.

As can be understood from the foregoing, according to the present invention, a door locking system for a motor vehicle which incorporates a luggage compartment lamp switch having a cost-reduction structure can be achieved. Moreover, a power supply circuit and terminals thereof for supplying power to the motor and a switching circuit and terminal thereof for the luggage compartment lamp switch can be constructed easily in an efficient manner.

Although the motor vehicle door locking system is used as a door locking system for locking and unlocking the trunk lid of a car (e.g., a sedan) in the above descriptions, the present embodiment of the motor vehicle door locking system can also be used as a door locking system for locking and unlocking the tailgate of a car (e.g., a station wagon).

Obvious changes may be made in the specific embodiment of the present invention described herein, such modifications being within the spirit and scope of the invention claimed. It is indicated that all matter contained herein is illustrative and does not limit the scope of the present invention.

What is claimed is:

1. A door locking system for a motor vehicle, comprising: a striker fixed to one of a car body and a car door; a base plate fixed to the other of said car body and said car door, said base plate having a striker leading slot in which said striker is removably insertable; a latch for latching said striker, said latch being pivoted on said base plate on one of opposite sides of said striker leading slot; a pawl for locking and unlocking said latch, said pawl being pivoted on said base plate on the other of said opposite sides of said striker leading slot; a rotary pressing member driven by a motor to come into contact with and rotate said pawl in a lock release direction to disengage said latch so that said latch releases said striker; and a rotatable opening lever which is rotated by a manual operation to rotate said pawl in said lock release direction to disengage said latch; wherein said rotary pressing member and said rotatable opening lever are pivoted about a common fixed shaft; and wherein said rotary pressing member and said rotatable opening lever are independently rotatable relative to each other about said fixed shaft.

2. The door locking system according to claim 1, further comprising a motor housing for housing said motor, said motor housing being made of synthetic resin mold; wherein said fixed shaft is formed integral with said motor housing; and wherein said base plate includes a support portion which supports a tip of said fixed shaft to be supported by said base plate when the motor housing is fixed to said base plate.

3. The door locking system according to claim 2, wherein said support portion of the base plate comprises a support hole into which a tip of said fixed shaft is fitted.

4. The door locking system according to claim 2, wherein said opening lever is supported on the fixed shaft to be held between the base plate and the rotary pressing member.

5. The door locking system according to claim 2, wherein said tip of said fixed shaft comprises a small-diameter tip portion; and wherein said opening lever is supported on the fixed shaft to be held between the base plate and an annular stepped portion formed around the base of said small-diameter tip portion.

6. The door locking system according to claim 2, wherein said support portion of the base plate comprises a support boss into which a hole formed on said tip of said fixed shaft is fitted.

7. The door locking system according to claim 1, wherein said rotary pressing member comes into contact with an engaging portion of said pawl to press said engaging portion when said rotary pressing member rotates said pawl in said lock release direction, said engaging portion being formed as a bent engaging portion.

8. The door locking system according to claim 7, wherein said rotary pressing member comprises a lock release cam, a cam surface of which is shaped so that a distance between the cam surface and an axis of rotation of said rotary pressing member increases gradually.

9. The door locking system according to claim 8, wherein said bent engaging portion comprises: a linear portion which extends in a radial direction of said axis of rotation of said pawl; and an inclined portion which extends obliquely with respect to said linear portion from an end of said linear portion; wherein said cam surface of said lock release cam first presses said inclined portion and subsequently presses said linear portion when said rotary pressing member rotates said pawl in said lock release direction to disengage said latch from said striker.

10. The door locking system according to claim 9, wherein said rotatable opening lever comes into contact with said linear portion to press said linear portion when said rotatable opening lever rotates said pawl in said lock release direction.

11. The door locking system according to claim 8, wherein said cam surface of said lock release cam is shaped so that said distance between said cam surface and said axis of rotation of said rotary pressing member increases gradually in a rotational direction thereof.

12. The door locking system according to claim 1, further comprising a luggage compartment lamp switch having a stationary terminal strip serving as a positive electrode and a movable terminal strip serving as a negative electrode; wherein said movable terminal strip is in contact with said stationary terminal strip when said striker is disengaged from said latch; and wherein said movable terminal strip is disengaged from said stationary terminal strip when said striker is engaged with said latch.

13. The door locking system according to claim 12, further comprising a motor housing for housing said motor, said motor housing being fixed to said base plate; wherein one end of said movable terminal strip is fixed to said motor housing.

14. The door locking system according to claim 13, further comprising a pair of terminal strips for supplying power to said motor; wherein said pair of terminal strips and said stationary terminal strip are formed integral with said motor housing by insertion molding; and wherein one of said pair of terminal strips which serves as a negative electrode is electrically connected with said movable terminal strip.

15. The door locking system according to claim 14, wherein said one end of said movable terminal strip and said one of said pair of terminal strips are fixed to said base plate by a set screw which is also used to fix said motor housing to said base plate.

16. The door locking system according to claim 13, wherein said motor housing comprises a holding device for temporarily holding said movable terminal strip before said motor housing is fixed to said base plate.

17. The door locking system according to claim 16, wherein said holding device comprises: a groove provided on said motor housing in which said one end of said movable terminal strip that is fixed to said motor housing is positioned; and two protrusions formed on said motor housing on opposite side surfaces of said groove to hold a portion of said movable terminal strip in the vicinity of said one end of said movable terminal strip between said two protrusions.

18. The door locking system according to claim 1, wherein said car door is a trunk lid or a tailgate.

19. The door locking system according to claim 1, wherein said rotary pressing member comprises a worm gear which is engaged with a worm on a rotary shaft of said motor.

20. The door locking system according to claim 1, further comprising a biasing member for biasing said rotary pressing member in a rotational direction opposite to a rotational direction in which said rotary pressing member is driven by said motor.

21. The door locking system according to claim 20, wherein said biasing member comprises a torsion coil spring installed between said motor housing and said rotary pressing member around said fixed shaft.

22. The door locking system according to claim 1, further comprising a spring for biasing said pawl and said latch to rotate in opposite rotational directions so as to engage with each other.

23. The door locking system of claim 1, wherein said rotatable opening lever comes into contact with an engaging portion of said pawl to press said engaging portion when said rotatable opening lever rotates said pawl in said lock release direction, said engaging portion being formed as a bent engaging portion.

24. A door locking system for a motor vehicle, comprising: a striker fixed to one of a car body and a car door; a base plate fixed to the other of said car body and said car door, said base plate having a striker leading slot in which said striker is removably insertable; a latch for latching said striker, said latch being pivoted on said base plate on one of opposite sides of said striker leading slot; a pawl for locking and unlocking said latch, said pawl being pivoted on said base plate on the other of said opposite sides of said striker leading slot; a motor which rotates a worm fixed to a rotary shaft of said motor; a cam-integrated worm wheel associated with said worm to be driven by said motor, wherein a lock release cam formed integral with said cam-integrated worm wheel comes into contact with and presses said pawl to rotate said pawl in a lock release direction to disengage said latch so that said latch releases said striker when said cam-integrated worm wheel is driven by said motor; and a rotatable opening lever which is rotated by a manual operation to rotate said pawl in said lock release direction to disengage said latch so that said latch releases said striker; wherein said cam-integrated worm wheel and said rotatable opening lever are pivoted about a common fixed shaft.

25. The door locking system of claim 24, wherein said lock release cam integral with said cam-integrated worm wheel is arranged to contact said pawl at an engaging portion of said pawl which is formed as a bent engaging portion.

26. The door locking system of claim 24, wherein said cam-integrated worm wheel and said rotatable opening lever are independently rotatable relative to each other about said fixed shaft.

27. The door locking system of claim 24, wherein said rotatable opening lever comes into contact with an engaging portion of said pawl to press said engaging portion when said rotatable opening lever rotates said pawl in said lock release direction, said engaging portion being formed as a bent engaging portion.

* * * * *

UNITED STATES PATENT AND TRADEMARK OFFICE

CERTIFICATE OF CORRECTION

PATENT NO. : 6,988,749 B2
APPLICATION NO. : 10/456504
DATED : January 24, 2006
INVENTOR(S) : Yasuhiro Hashiba It is certified that error appears in the above-identified patent and that said Letters Patent is hereby corrected as shown below:

Column 15, line 19, after “are” insert -- each --.

Signed and Sealed this

First Day of August, 2006

JON W. DUDAS
*Director of the United States Patent and Trademark Office*